US005762211A

United States Patent [19]

Ensign

[11] Patent Number: 5,762,211

[45] Date of Patent: Jun. 9, 1998

[54] ARTICLE ORGANIZATION AND DISPLAY SYSTEM

[76] Inventor: Lance Ensign, 4781 Ewing Rd., Castro Valley, Calif. 94546

[21] Appl. No.: 784,240

[22] Filed: Jan. 15, 1997

[51] Int. Cl.[6] ..... A47F 7/00

[52] U.S. Cl. ..... 211/70.6; 211/4

[58] Field of Search ..... 211/70.6, 4; 70/59, 70/61, 62

[56] References Cited

U.S. PATENT DOCUMENTS

| | | | |
|---|---|---|---|
| 2,405,369 | 8/1946 | Paulsen . | |
| 3,855,943 | 12/1974 | Larson . | |
| 4,598,827 | 7/1986 | Kiefer . | |
| 4,893,777 | 1/1990 | Gassaway | 70/62 |
| 5,154,072 | 10/1992 | Leyden | 211/4 |

*Primary Examiner*—Peter M. Cuomo
*Assistant Examiner*—Anthony D. Barfield
*Attorney, Agent, or Firm*—Bielen, Peterson & Lampe

[57] ABSTRACT

An article organizer and display system constructed with a front display panel having a plurality of constricted apertures in an array and a plurality of suspension tethers each having one end that engages nd is retained by a selected constricted aperture and an opposite end that attaches to an article such as a tool or sale item to display the item against the panel, the system including a backing panel with a plurality of studs aligned with the constricted apertures with a displacement mechanism to displace the backing panel to a position proximate the display panel locking the tethers on the display panel.

17 Claims, 2 Drawing Sheets

ARTICLE ORGANIZATION AND DISPLAY SYSTEM

BACKGROUND OF THE INVENTION

This invention relates to an article organization and display system for arranging articles on a panel for convenient storage or display. In general, the organization and display system is similar in use to a common peg-board that allows the user to arrange articles at any of numerous optional locations provided by holes in a panel. The panel holes comprise mounting holes for brackets or hooks that are part of a peg-board organizing system.

Although the peg-board system is convenient for many applications in both home-use for tools and the like, or commercial displays for items on sale, special brackets, posts or hooks must be provided to accommodate particular types of articles.

The article organization and display system of this invention utilize the advantage of multiple apertures for selectively locating articles, but avoids the requirement of a set of support hardware that must be moved when the preferred location of an article or item is changed.

It is an object of this invention to provide an organization and display system that is suitable for home use in organizing tools or the like, or that is suitable for commercial use for display of items for sale.

It is another object of this invention to provide a convenient hanging tether attached to the article or item for selectively supporting the article or item at any one of multiple locations of a organizer panel.

Although the article organization and display system is here disclosed as an open panel with an optional backing to lock the tethered articles in place, it is to be understood that the size of the system or the incorporation of the system into other mounting or display systems does not change the basic mechanism to engage the articles with the display panel. The panel is preferably oriented vertically or at an incline to maintain the connecting item tether in engagement with the panel slots. The display panel in this position can be moved without dislodging the attached articles. When the optional backing is placed in position to lock the article tethers in place, the panel can assume any orientation without dislodging the displayed items. This feature may be useful when the panel is used to organize tools in a transport container such as a tool box, or when the panel is used to display items to customers where it is desired to prevent removal of the items by the customer without assistance from the display owner.

SUMMARY OF THE INVENTION

The article organization and display system of this invention comprises a display panel with an array of spaced apertures similar to a peg-board. The spaced apertures are preferably configured in the form of a keyhole with an enlarged circular hole in open communication with a slot-like keyway having a width narrower than the circular hole.

The display panel is preferably oriented vertically and in the preferred embodiment is arranged in combination with a backing panel having an array of raised pegs or studs aligned with the circular hole portion of the constricted aperture. The constricted aperture permits articles to be suspended from a connected tether having an enlargement at its distal end that engages the constricted aperture. With the constricted aperture having its constricted portion oriented below the enlarged portion, the enlargement at the end of the tether, sized to enter the enlarged portion of the aperture, becomes retained when disposed behind the constricted portion of the aperture. The enlargement can be of any functionally operational configuration, and is most simply represented by a spherical ball at the end of a line. Similarly, the constricted aperture can be of any functionally operational configuration that retains the ball, but allows the tether line to pass. Using the spherical ball, the keyhole configuration with an enlarged hole portion to receive the ball and a narrow slot portion to receive the line is effective.

With the backing panel in locking position, articles suspended from the tether are not dislodged when the combined panels are moved. In this manner, the display panel is useable for organizing tools and the like on a wall board or in an organizer panel in a briefcase-like tool kit or tool box. Similarly, if the display system is used for articles of a commercial nature, such as product items, the backing panel can be displaced to a locking position preventing removal of the product item from the display panel without severing the tether line. This feature deters theft in addition to allowing the display system to be movable from place to place without dislodging the product items.

In the preferred embodiment, a simple inexpensive means for retaining tethered articles on the display panel is shown by the use of the backing panel having an array of raised pegs or studs aligned and affixedly lodged within the enlarged portion of the constricted apertures of the display panel. It is to be understood that other means such as a backing panel having an array of aligned apertures that move to partially block the enlarged portion of the constricted apertures of the display panel may be equally effective to retain the tethered articles.

These and other features of the article organizer and display system will be apparent from a consideration of the detailed description of the preferred embodiments.

DETAILED DESCRIPTION OF THE PREFERRED EMBODIMENTS

Figure 1:
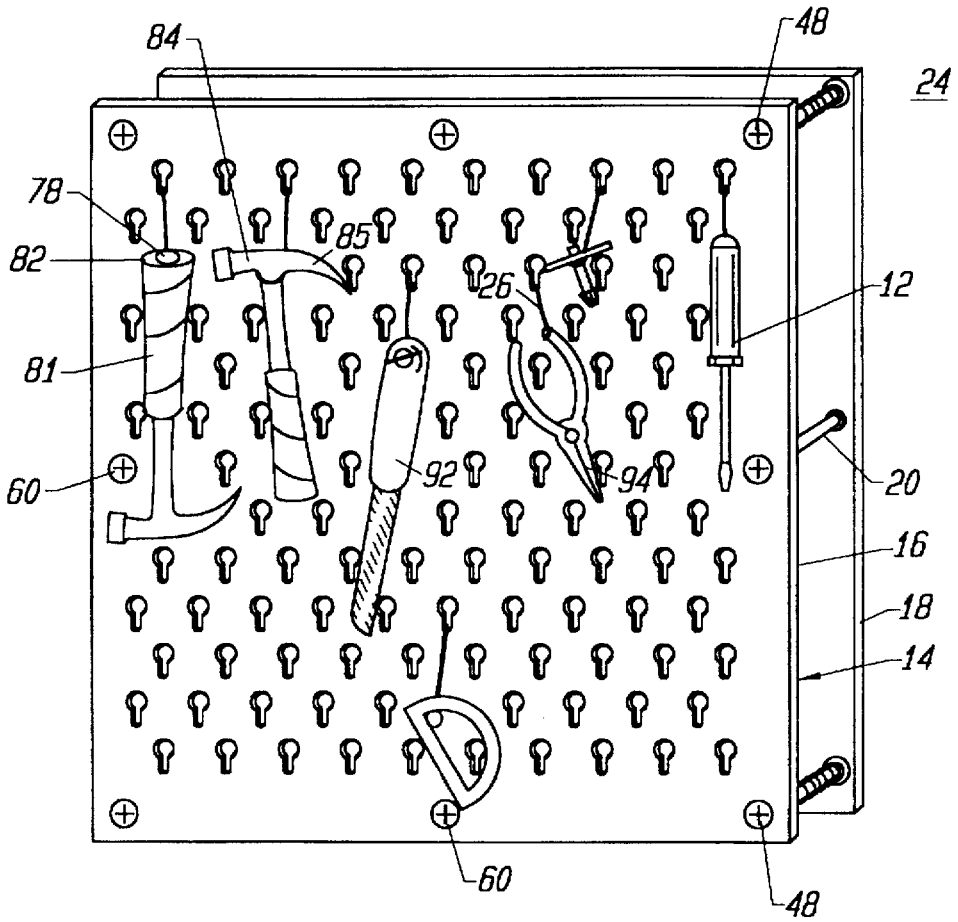
FIG. 1 is a front perspective view of the article organizer and display system of this invention.

Referring to the perspective view of FIG. 1, the article organization and display system of this invention, designated by the reference numeral 10 is shown. The display system 10 is shown with a plurality of articles, collectively designated by the reference numeral 12, suspended from a display unit 14 that primarily consists of a display panel 16 coupled to a backing panel 18. The display panel 16 is positioned in front of the backing panel 18 and is connected to the backing panel by an interconnecting mechanism 20 that permits relative displacement of the backing panel with relation to the front panel. The connecting mechanism 20 of the display unit 14 is, in its simplest form, a set of screw connectors 22, that not only permits the display unit 14 to be connected to a wall surface 24, but actuates the displacement of the backing panel 18 relative to the display panel 16.

The articles 12 are suspended from a tether 24, that is a part of the article organization and display system 10. The tether 24 has a line 26 that attaches to an article 12 by one of a variety of attachment elements 28, as shown in FIG. 4A to FIG. 4G. The line 26 is flexible to permit ease of use of the tool, but may be rigid or semi-rigid, such as a stiff wire, to provide ease of insertion into or removal from the constricted aperture of the display panel. At the distal end of the line 26 from the attachment element 28, the tether 24 has an enlargement 30 that releasably engages one of a plurality of constricted apertures 32 in an aperture array 34 on the front surface 35 of the display panel 16.

Figure 2:
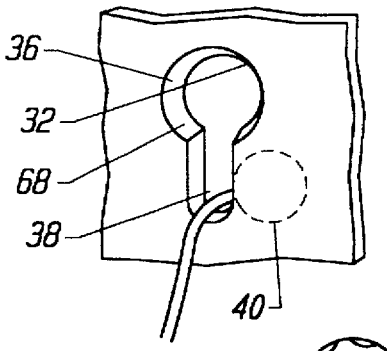
FIG. 2 is an enlarged view of a typical constricted aperture in the display panel of the display system of FIG. 1.
Figure 3:
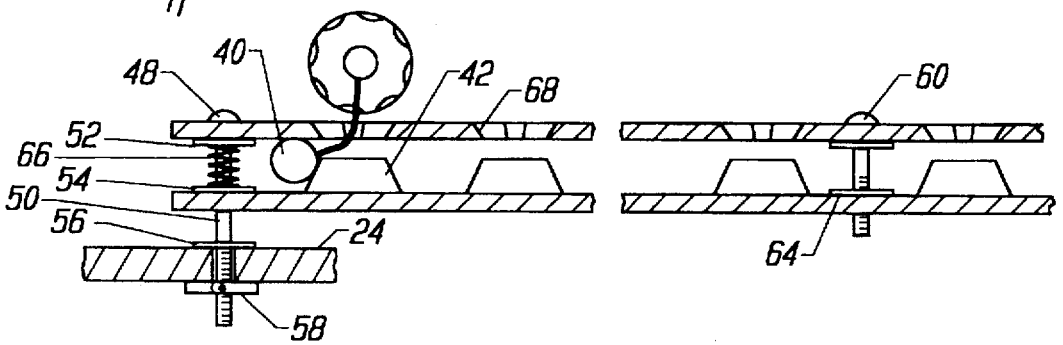
FIG. 3 is an enlarged, partial cross sectional view taken on the lines 3—3 in FIG. 1.

Referring to the enlarged partial views of the display unit 14 in FIGS. 2 and 3, the constricted apertures 32 have the configuration of a keyhole with a circular portion 36 and a slot portion 38. The enlargement 30 is sized to pass through the circular portion 36 of the constricted aperture to a location between the display panel 16 and backing panel 18 and drop to a position that locates the tether line 26 in the slot portion 38 anchoring the enlargement 30, which is shown as a small spherical ball 40. In this manner, the articles to be displayed are suspended against the front display surface 35 of the display panel 16 by the tether 24 in an arrangement determined by the user.

The backing panel 18 has a plurality of studs 42 arranged in an array 44 that is aligned with the array 34 of constricted apertures 32. This alignment is maintained by the screw connectors 22 in connecting the display panel 16 to the backing panel 18. When the backing panel 18 is displaced toward the display panel 16 as shown in FIG. 3, the studs 42 are positioned proximate the circular portion 36 of the constricted apertures 32. This positioning provides a limited clearance between the display panel 16 and the studs 42 that is adequate for the line 26 of the tether 24, but not the ball 40. In this position, the enlargements 30 of the tethers are trapped thereby fixedly attaching the tethers and attached articles 12 to the display panel 16. In this position, the display unit 14 may be moved about without dislodging the articles from the display panel 16.

It is to be understood that interconnecting the display panels 16 and 18 with screw connectors 22 is provided as a cost-effective and simple expedient to demonstrate an actuating mechanism or means for interconnecting and displacing the backing panel 18 with respect to the display panel 16. The means shown is functional for use of the display system as a display unit in a stationary home shop or a movable utility van where it is desirable to suspend articles 12 such as the tools 46 shown in FIG. 1 from the display unit. While the screw connectors 22 deter theft, they can be manipulated with a common Phillips screwdriver, freeing the tools 46 from the display panel 16. In the setting of a commercial outlet where the articles 12 comprise product items, greater theft proofing can be accomplished by sealing the means to displace the backing panel 18 with respect to the display panel 16.

As shown in greater detail in FIG. 3, the screw connectors 22 of the interconnecting means 20 are of two primary types. At the corners of the display unit 14 are wall connectors 48 which comprise an elongated machine screw 50 having a washer 52 on the underside of the display panel 16, a washer 54 on the topside of the backing panel 18 and a fixed collar 56, that provides a stop when the machine screw 48 is threaded into an expansion nut 58 in the wall 24. The other screw connector 22 comprises an adjustment screw 60 that has a high thread pitch to enable quick displacement of the backing panel with a few turns of the screw. The high pitch adjustment screw 60 engages a threaded nut 64 fixed to the top side surface of the backing panel 18. Turning of the adjustment screws 60 displaces the display panel with respect to the backing panel. To maintain respective positions of the panels, a mild compression spring 66 is located between the washers 52 and 56 on the corner machine screws 48. Several turns on each of the four adjustment screws 60 will displace the backing panel 18 from an inoperative position to a locking position.

Various embodiments of the tether 24 are shown in FIG. 4A to FIG. 4G. Each tether 24 has an enlargement 30 in the form of a spherical ball 40 that is sized to fit through the constricted aperture 32 shown in FIGS. 2 and 3. The constricted apertures 32 are preferably flared as shown in FIG. 3 with an incline or chamfered opening edge 68 to facilitate the placement of the ball 40 in the enlarged circular portion 36 of the constricted aperture 32. The tether 24 includes the line 26 which in the embodiment of FIG. 4A may comprise a series of locking elements 70 that engage a locking mechanism 72 in the manner of a common tie strap. The tie strap 72 forms a loop 74 that can be tightened around a portion of a tool or other display item for suspending from the display panel 16.

Figure 4A:
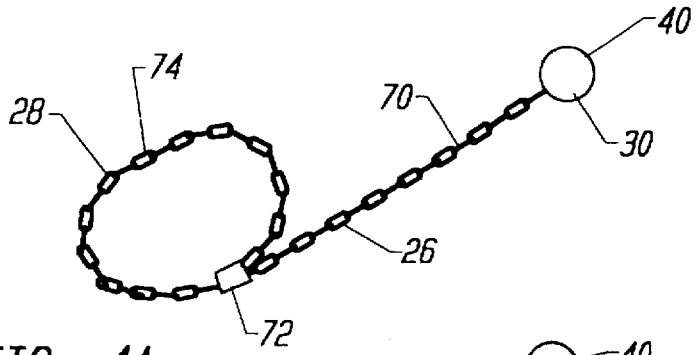
FIG. 4A is an enlarged view of a first embodiment of a tether in the article organizer and display system.
Figure 4B:
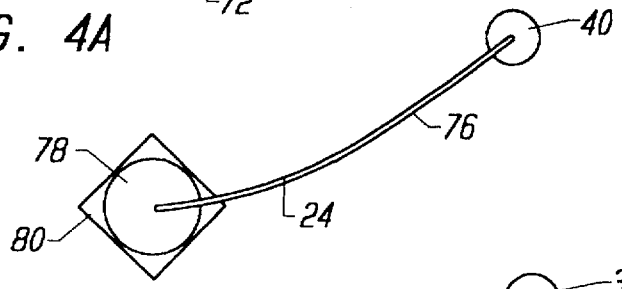
FIG. 4B is an enlarged view of a second embodiment of a tether in the article organizer and display system.

Alternately, the tether 24 as shown in FIG. 4B includes a ball 40 connected to a nylon filament 76 that is connected to a flat adhesive pad 78 with a peel-off protector 80 allowing the adhesive surface (not visible) to be adhered to a tool such as the handle butt 82 of the hammer 84 shown in FIG. 1.

Figure 4C:
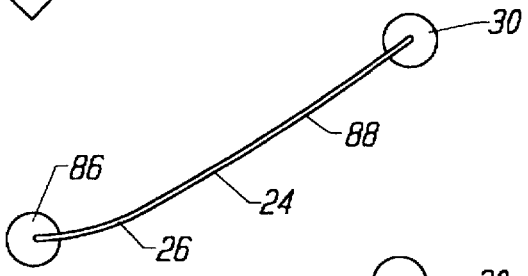
FIG. 4C is an enlarged view of a third embodiment of a tether in the article organizer and display system.

Certain articles such as the claw hammer 84 in FIG. 1 can be suspended from the claw end 85 by a similar enlargement as the ball 86 on the tether 24, shown in FIG. 4C.

Figure 4D:
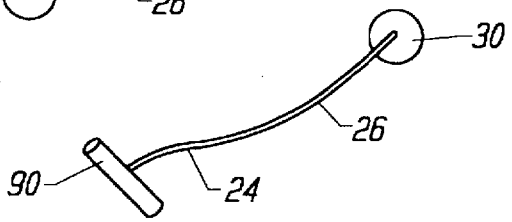
FIG. 4D is an enlarged view of a fourth embodiment of a tether in the article organizer and display system.

Alternately, the tether 24 as shown in FIG. 4D, may comprise a ball 30, a line 26 and cross-tee 90 made of a flexible material that may poke through an existing hole in a tool as shown for the file 92 in FIG. 1.

Figure 4E:
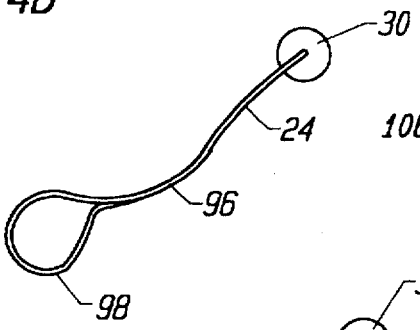
FIG. 4E is an enlarged view of a fifth embodiment of a tether in the article organizer and display system.

Alternately, for difficult to attach tools such as the pliers 94 in FIG. 1, the tether 24 as shown in FIG. 4E comprise a ball 30 connected to a heat shrinkable band 96 with an end loop 98 that shrinks around an element when mildly heated.

Figure 4G:
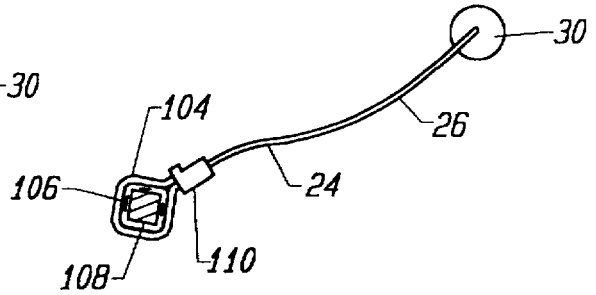
FIG. 4G is an enlarged view of a seventh embodiment of a tether in the article organizer and display system.
Figure 4F:
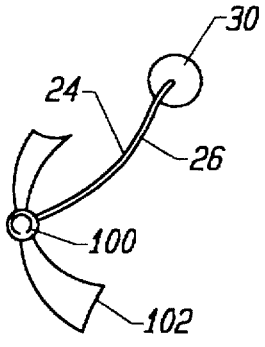
FIG. 4F is an enlarged view of a sixth embodiment of a tether in the article organizer and display system.

As shown in FIG. 4F, another alternate embodiment of the tether 24 has a line 26 with an enlargement 30 at one end and a small ring 100 with a segment of adhesive tape 102 threaded through the ring 100. The segment of adhesive tape 102 easily attaches to an article at a convenient location and provides a means to connect the tether to a variety of articles.

As shown in the alternate embodiment of FIG. 4G, the tether 24 has a line 26 with an enlargement 30 at one end and a loop 104 at the other end. A tape wrap 106 around a tool element, here the shank 108 of a screwdriver shown in cross section, provides a cushion for the loop 104 when tightened around the shank 108 over the tape wrap 106 using a slip ring 110 which is crimped in its tightened position as shown.

Each of the tethers shown in FIGS. 4A to 4G is inexpensive to fabricate and may be provided separately or in a set of one or more different tethers. The tether lines 26 may be plastic, or twisted steel cable, depending on the degree of security desired. It is to be understood that other equivalent attachment means may be devised to conveniently connect an article 12 to the display unit 14.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An article organizer and display system comprising:

an article display panel having a front display surface sized to display a plurality of articles against the front display surface, and an array of constricted apertures through the display panel distributed substantially over the entire front display surface and spaced to display a plurality of articles in an arrangement for determination by a user; and, a plurality of tether members each tether member having a line with first and second ends, an enlargement at the first end and an article attachment means at the second end for attaching articles to be displayed on the front display surface of the display panel;

wherein the constricted aperture and the enlargement of the tether members are cooperatively sized and configured to releasably retain the first end of the tether member when the display panel is vertically oriented and the enlargement is passed through one of the constricted apertures in the display panel wherein articles attached to the second end of the tether member retained in the constricted apertures are suspended against the front display surface.

2. The article organizer and display system of claim 1 wherein the constricted apertures each have a first portion sized to pass the enlargement at the first end of the line of the tether members, and a second portion sized to pass the line of the tether member and retain the enlargement of the tether member, wherein the front display surface of the display panel is substantially vertical and the first portion of the constricted aperture is above the second portion of the constricted aperture.

3. The article organizer and display system of claim 2 wherein at least the first portion of the constricted aperture has chamfer means for facilitating placement of the enlargement of the tether member through the constricted aperture.

4. The article organizer and display system of claim 2 wherein the first portion of the constricted aperture is circular and the second portion of the constricted aperture is slot-like, the two portions forming a constricted aperture that is configured in the form of a keyhole.

5. The article organizer and display system of claim 1 wherein the array of constricted apertures are arranged in multiple uniform rows.

6. The article organizer and display system of claim 1 in combination with a backing panel positionable proximate the display panel, the backing panel having means for locking the retained enlargement of the tether members when the enlargements are passed through the constricted apertures in the display panel.

7. The article organizer and display system of claim 6 wherein the backing panel is displaceable from the display panel a distance permitting the enlargement of the tether member to be located between the display panel and backing panel.

8. The article organizer and display system of claim 6 wherein the backing panel has an array of projecting studs aligned with the constricted apertures of the display panel and the means for interconnecting the backing panel to the display panel includes displacement means for displacing the backing panel relative to the display panel whereby the enlargements of tether members installed between the display panel and the backing panel are retained when the backing panel is proximate the display panel.

9. The article organizer and display system of claim 1 wherein the article attachment means comprised a noose with locking means.

10. The article organizer and display system of claim 1 wherein the article attachment means comprises an adhesive pad.

11. The article organizer and display system of claim 1 wherein the article attachment means comprises an enlargement similar to the enlargement at the first end of the line.

12. The article organizer and display system of claim 1 wherein the article attachments means comprises a crossbar.

13. The article organizer and display system of claim 1 wherein the article attachment means comprises a loop of heat shrinkable band.

14. The article organizer and display system of claim 1 wherein the article attachment means comprises a segment of adhesive tape.

15. The article organizer and display system of claim 14 wherein the segment of tape is wrapped around an element of an article to be displayed, the article attachment means comprising, in addition, a loop at the end of the line having a slip ring for tightening the loop around the wrapped tape on the article.

16. The article organizing and display system of claim 1 wherein the article attachment means comprises a tether integrally manufactured into an article to be displayed.

17. An article organizer and display system comprising:

a display panel having a front surface and an array of constricted apertures through the display panel distributed over the front surface; and, a plurality of tether members each tether member having a line with first and second ends, an enlargement at the first end and an article attachment means at the second end for attaching articles to be displayed on the front surface of the display panel;

wherein the constricted aperture and the enlargement of the tether members are cooperatively sized and configured to releasably retain the first end of the tether member when the enlargement is passed through one of the constricted apertures in the display panel and wherein the display panel is combined with a backing panel and means for interconnecting the backing panel to the display panel wherein the backing panel has an array of projecting studs aligned with the constricted apertures of the display panel and the means for interconnecting the backing panel to the display panel includes displacement means for displacing the backing panel relative to the display panel whereby the enlargements of tether members installed between the display panel and the backing panel are retained when the backing panel is proximate the display panel.

* * * * *